US005860378A

United States Patent [19]

Schaller

[11] Patent Number: 5,860,378

[45] Date of Patent: Jan. 19, 1999

[54] RECREATIONAL WATER VESSEL

[76] Inventor: Robert Joseph Schaller, 3285 Westwood Dr., Titusville, Fla. 32796

[21] Appl. No.: 922,248

[22] Filed: Sep. 2, 1997

[51] Int. Cl.[6] ..... B63B 35/00

[52] U.S. Cl. ..... 114/39.1; 114/61; 440/27

[58] Field of Search ..... 114/61, 123, 283, 114/292, 39.1; 440/21, 26, 27, 28, 29, 30, 31

[56] References Cited

U.S. PATENT DOCUMENTS

| | | | |
|---|---|---|---|
| 3,010,421 | 11/1961 | Perkins . | |
| 3,185,125 | 5/1965 | Haman | 440/27 |
| 3,211,125 | 10/1965 | Yarbrough . | |
| 3,316,873 | 5/1967 | Dismukes | 114/61 |
| 3,440,995 | 4/1969 | Welsh . | |
| 3,791,329 | 2/1974 | Bruning | 114/61 |
| 4,108,100 | 8/1978 | Jamieson . | |
| 4,323,352 | 4/1982 | Warren et al. | 440/27 |
| 4,408,772 | 10/1983 | Hollwarth | 114/61 |
| 4,930,433 | 6/1990 | Tirez | 114/61 |
| 5,024,177 | 6/1991 | Winter et al. . | |
| 5,217,398 | 6/1993 | Meron et al. . | |

*Primary Examiner*—Stephen Avila

*Attorney, Agent, or Firm*—Robert L. Wolter, Esq.; Holland & Knight LLP

[57] ABSTRACT

The present invention is for a recreational water vessel that may by operated driven by a manually operated propeller and drive system or it may be driven by wind under sail. The vessel includes two boards mounted to a main frame. Each board has a concave shaped bottom surface and an inner side surface that is vertically disposed with respect to the surface of the water. The drive system operates two propellers simultaneously and/or independently. A key mechanism may be biased between a position to operate the propeller simultaneously and independently. The vessel has a mast that is mounted toward the rear or stern of the main frame. A boom is mounted forward of a seat. A sail has a top mounted to the mast and a clew mounted to the boom. The sail is triangular such that a fold extends from the boom to the mast forming two halves of the sail.

39 Claims, 9 Drawing Sheets

RECREATIONAL WATER VESSEL

BACKGROUND OF THE INVENTION

Water vessels are powered by a variety of propulsion means including motors or sails. Engine powered vessels unfortunately present problems to the environment. Engines may leak fuel contaminating the water. In addition, the prop and propeller from engines on motor-powered boats may harm subsurface structures as coral or grass flats. Awareness and sensitivity toward the environment have created a demand for water vessels that avoid such problems. Moreover, motor-powered boats have inherent problems including handling large, heavy vessels on land or mechanical failures in the engine.

Many recreational boaters prefer sailing vessels to motor boats. Sailing vessels offer a different challenge in the operation of the vessels by propelling the boat with aid of wind and skill provided by the boater. In addition, there are water vessels available that provide more physical exertion for exercise. Many such water vessels have propellers that are rotated by a pedal means.

SUMMARY OF THE INVENTION

In view of the foregoing, it is the object of the present invention to provide a water vessel that is environmentally safe. Another object of this invention is to provide a vessel that is capable of traveling in shallow waters that may not be otherwise accessible by motor boats. Still another object of this invention, is to provide a vessel that combines the skill of sailing and the exercise of pedaling.

These and other objectives are achieved by the present invention for a water recreational vessel which includes two boards secured in fixed spaced relationship by a frame mounted to the boards. A seat is mounted on the frame for a user to operate the vessel. Each of the boards has a top surface and a bottom surface. The bottom of each of the boards has a concave shape and the boards are mounted to the frame such that the bottom of the boards is angled outward. Each board has a vertically disposed inner side surface with respect to the frame and water surface. This positioning of the boards causes the inner side surfaces to serve as a centerboard or keel for the vessel.

The vessel may be propelled by a pedal operated propeller system that includes dual propellers mounted to the rear of the frame. Each pedal is drivably connected to a corresponding gear system which in turn drives a flexible axle that extends from the gear system to the propeller. The pedals are interconnected such that when the pedals are operated, the propellers are simultaneously driven. There is also a means for disengaging one pedal from the other pedal so that the propellers may be driven independent of the other The vessel may also be operated under sail. A mast is mounted on the rear of the frame behind the seat and extends upward. A boom is attached to the frame in front of the seat and pivots toward a starboard and port side of the vessel. A sail is attached to the boom and mast so a user may operate the sail from the seat.

In addition, the vessel includes a means for adjustment of the propellers between an operational position to a storage or sailing position.

DETAILED DESCRIPTION OF THE DRAWINGS

Figure 1:
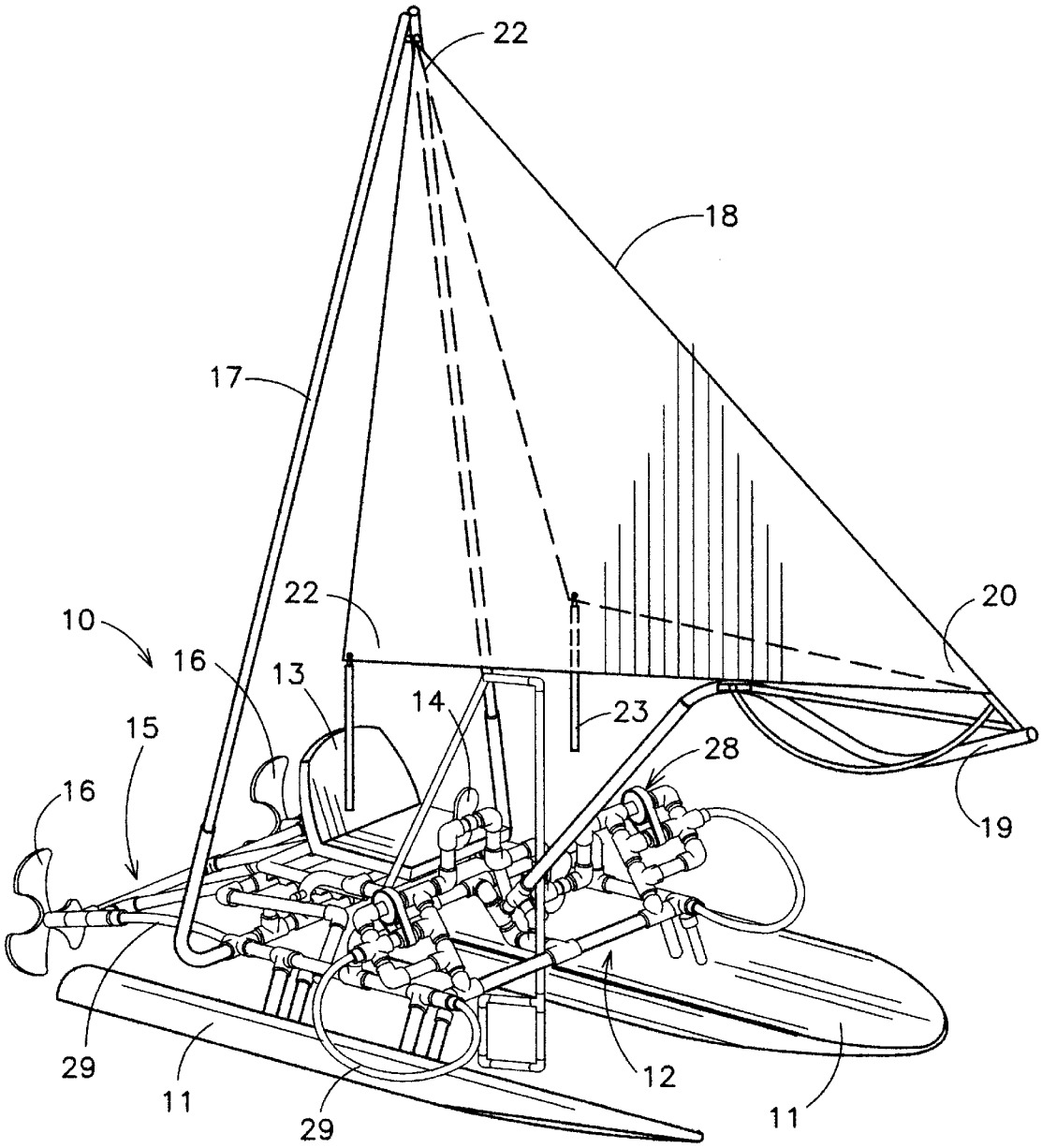
FIG. 1 is a perspective view of the invention.
Figure 2:
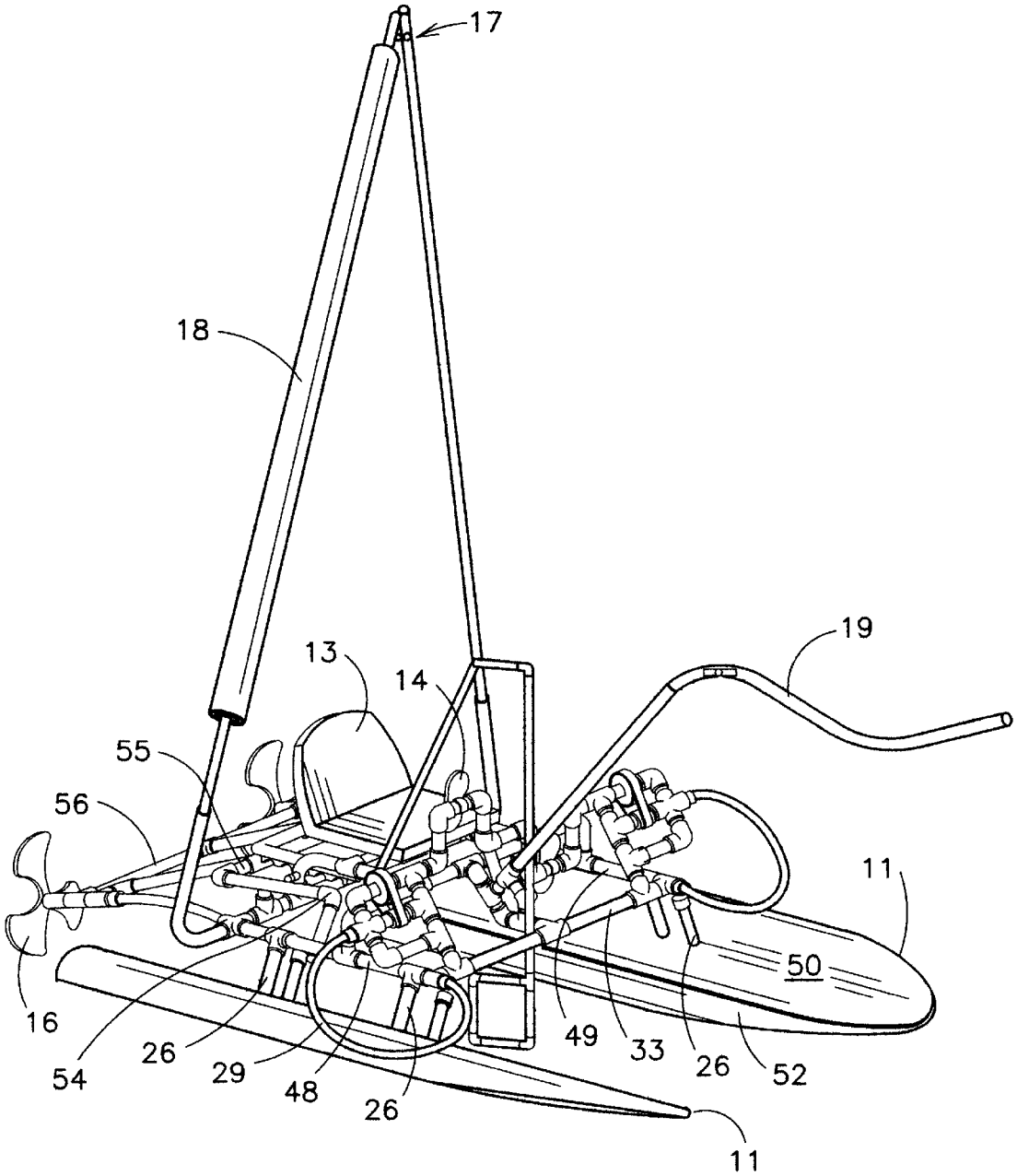
FIG. 2 is a perspective view of the invention with the sail in a stored position.

The recreational water vessel 10 that is the subject invention is depicted in FIG. 1 and FIG. 2, and may be described as a modified catamaran. The water vessel 10 has two surfboards (or boards) 11 adapted to serve as pontoons or floating devices for the vessel 10. The boards 11 support a main frame 12 which in turn supports the propulsion means for the vessel 10 and the seat 13. The frame 12 includes a forward cross member 33 and a rear cross member 34, as well as two side members 48 and 49.

The frame 12 is supported on the surfboards 11 by stanchions 26 which are connected to the support members 27 embedded in the interior of the surfboards 11. With respect to FIGS. 10 through 13, each surfboard 11 includes a top surface 50 and a bottom surface 51. As shown in FIGS. 1 and 2, the surfboard 11 also has an inner side surface 52 and an outer side surface 53 in relationship of its position on the vessel 10.

Figure 12:
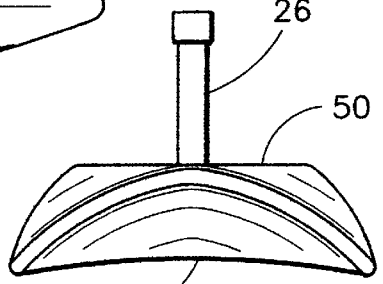
FIG. 12 is a front elevational view of a board on the invention.
Figure 11:
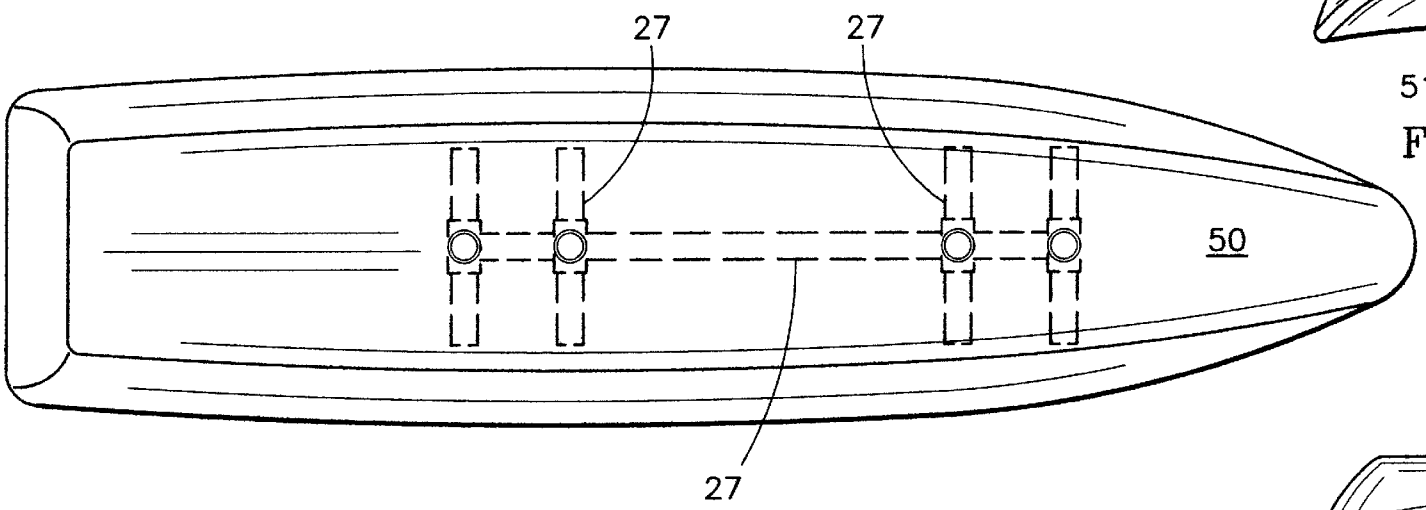
FIG. 11 is a top view of a board on the invention.
Figure 13:
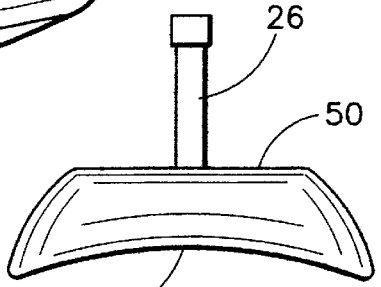
FIG. 13 is a rear elevational view of a board used on the invention.

As noted above, the shape of the boards 11 have been modified so the boards 11 support the frame 12 in the water. The boards 11 in FIGS. 12 and 13 are disposed in a substantially horizontal position. The side surfaces 52 and 53 are beveled slightly and form an angle of about 45° with respect to the top surface 50. The bottom surface 51 of each board is concave. On a board ten (10) feet long, from bow to stern, the concave bottom surface extends from the stern toward the bow about eight (8) feet. The radius of the bottom surface is preferably about forty-eight inches (48").

The boards have a beam of 24" and the stanchions 26 are centered on the board. In addition, the embodiment illustrated in the attached drawings show stanchions spaced 38", 42", 74" and 80" from the stem of the board.

Figure 5:
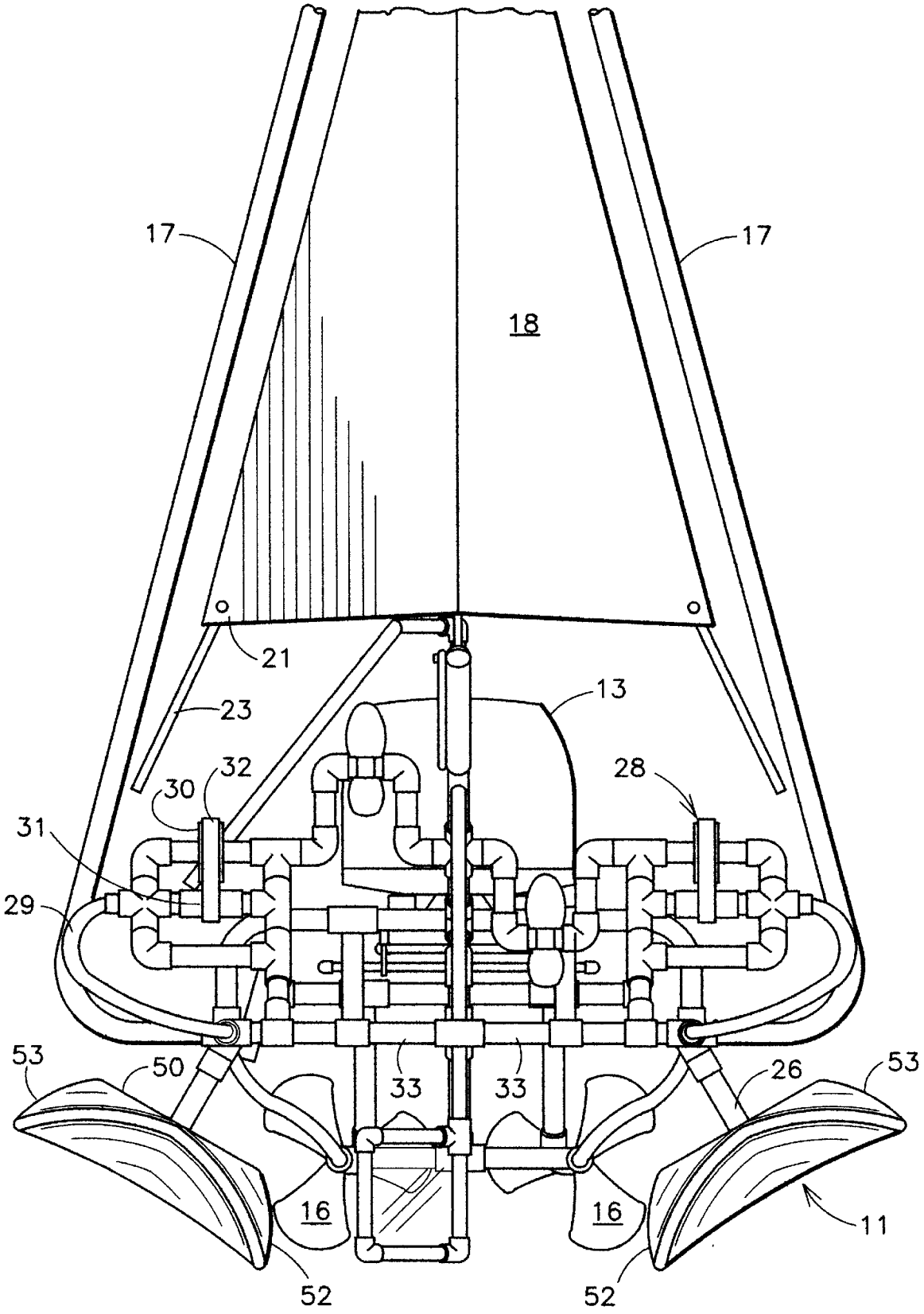
FIG. 5 is a front elevational view of the invention.
Figure 6:
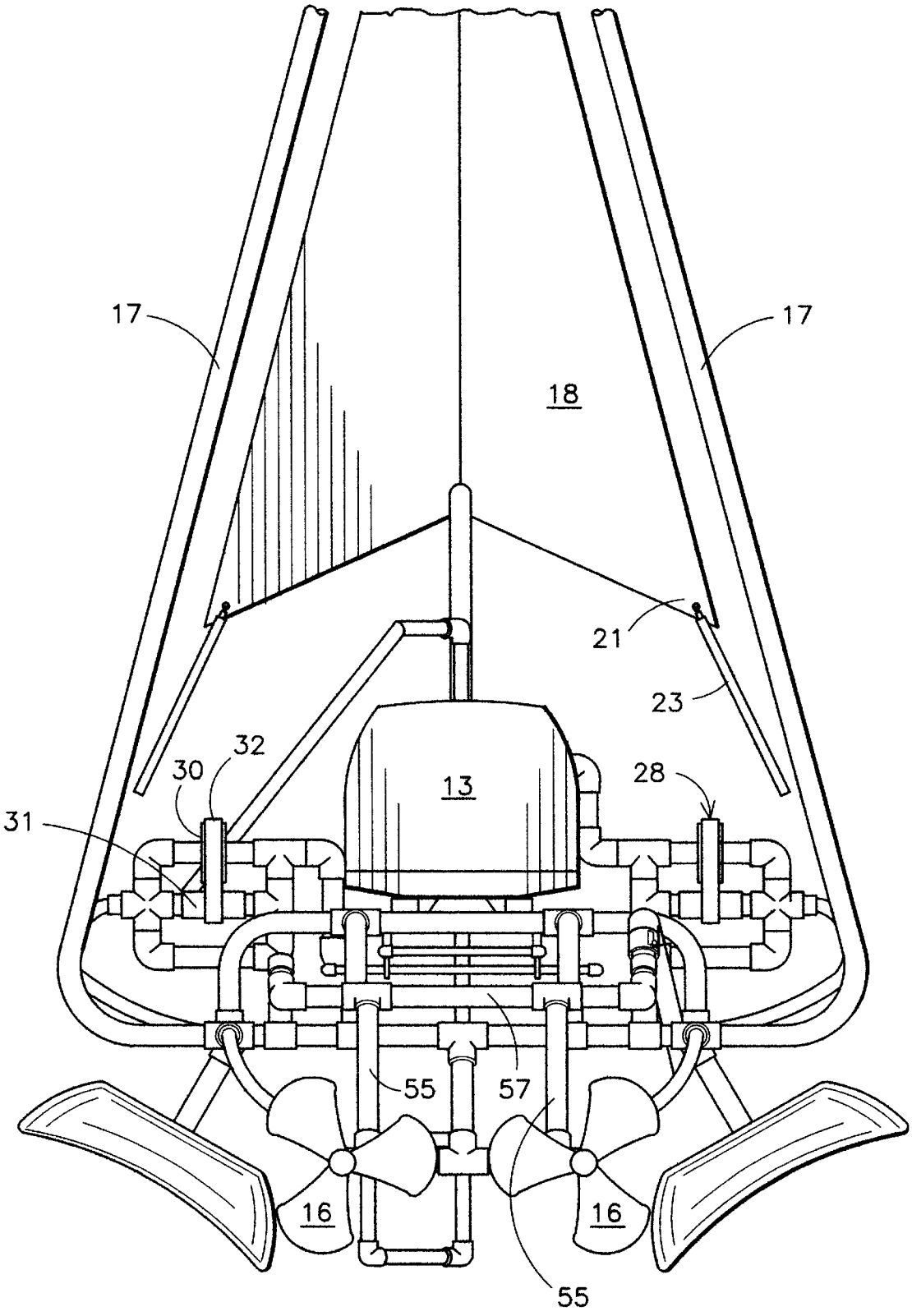
FIG. 6 is a rear elevational view of the invention.

With respect to FIGS. 5 and 6, the stanchions 26 are attached to the side members 48 and 49 bottom of each board 11 faces outward toward respective sides of the frame 12. The stanchions 26 are displaced about 30° off of vertical toward the side members 48 and 49. In this position, the inner side surface 52 of the surfboards 11 are substantially vertical and are substantially perpendicular to the rear cross member 34 and forward cross member 33 on frame 12. The inner side surfaces 52 of the surfboards are substantially vertical with respect to a water line, and the side surfaces 52 serve as a centerboard or keel for the vessel 10. In addition, the concave bottom surface 51 balances the vessel in the water.

A drive system including pedals 14 is mounted to the frame 12. The pedals 14 and drive system are used to manually operate the two propellers 16 which are mounted to a propeller frame 15. The propeller frame 15 is mounted to the frame 12. The pedal 14 on the starboard side of the vessel 10 drives the propeller 16 on the same side, and the pedal 14 on the port side of the vessel 10 drives the propeller 16 on the same side. As will be explained in more detail below the drive system, including the pedals 14, and the two propellers 16 may be operated in tandem so that the propellers 16 rotate concomitantly. In addition, the drive system may be operated so the two pedals 14, and consequently the propellers 16, operate independently with respect to one another.

A mast 17 is mounted to the rear cross member 34 and a boom 19 is mounted to the frame forward the mast 17 and seat 13. A sail 18 is connected to the mast 18 and boom 19. The boom 19 extends forward of the pedals 16 and drive system. The sail 18 has a triangular shape having a sail top 22 attached to the mast 17, and a clew 20 attached toward an end of the boom 19. As shown in the rear view in FIG. 6, the sail is folded at its center from the boom 19 to the mast 17 and therefore it has two feet 21.

Figure 7:
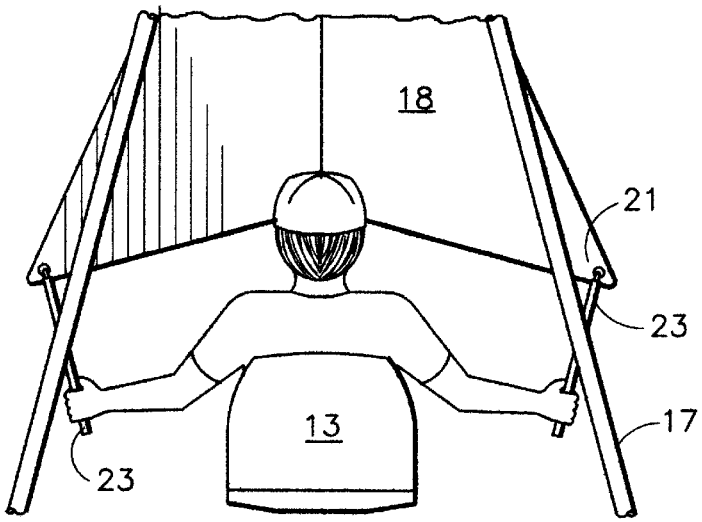
FIG. 7 is a view of the sail opened for downwind sailing.
Figure 8:
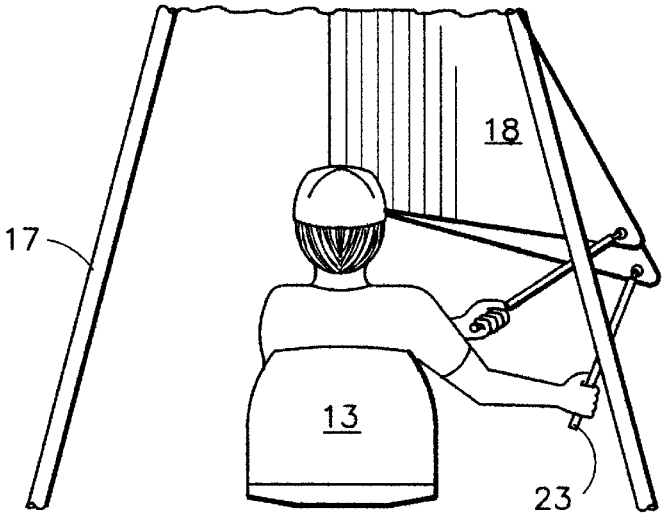
FIG. 8 is a view of the sail position toward a starboard side of the invention.
Figure 9:
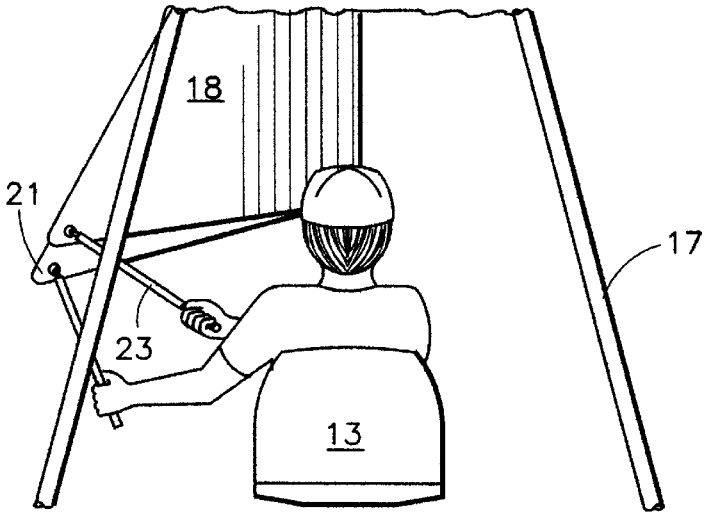
FIG. 9 is a view of the sail position toward the port side of the invention.
Figure 10:
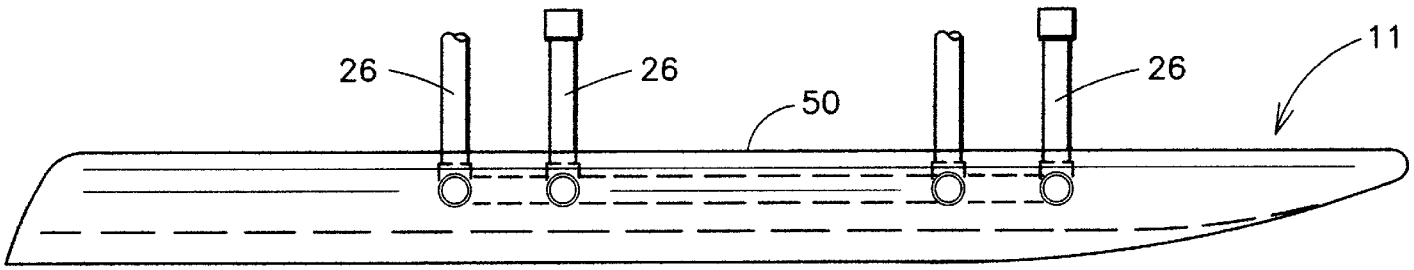
FIG. 10 is a side elevational view of a board on the invention.

As shown in FIGS. 7 through 9, sail handles 23 are attached to each foot 21 of the sail 18 to operate the sail 18. When sailing downwind the sail 18 is opened as shown in FIG. 7. When sailing on a close haul to a broad reach the sail 18 is folded and placed on the starboard (as shown in FIG. 8) or port side (as shown in FIG. 9) of the vessel depending on the wind direction. The sail 18 is stored by folding the sail and rolling it around one of the mast arms as shown in FIG. 2.

If the sail 18 is not in use, the propellers 16 may be operated to propel the vessel 10. The propellers 16 are operated by the drive system which includes pedals 14, gear system 28 and flexible axles 29 to drive the propellers 16. Each pedal 16 is drivably connected to a first gear 30, and is rotated to drive the first gear 30. A belt 32 engages the first gear 30 and second gear 31. A flexible axle 29 extends from each second gear 31 through a corresponding side member 48 and side member 49 and through the propeller frame 15, and is connected to the propellers 16.

Figure 3:
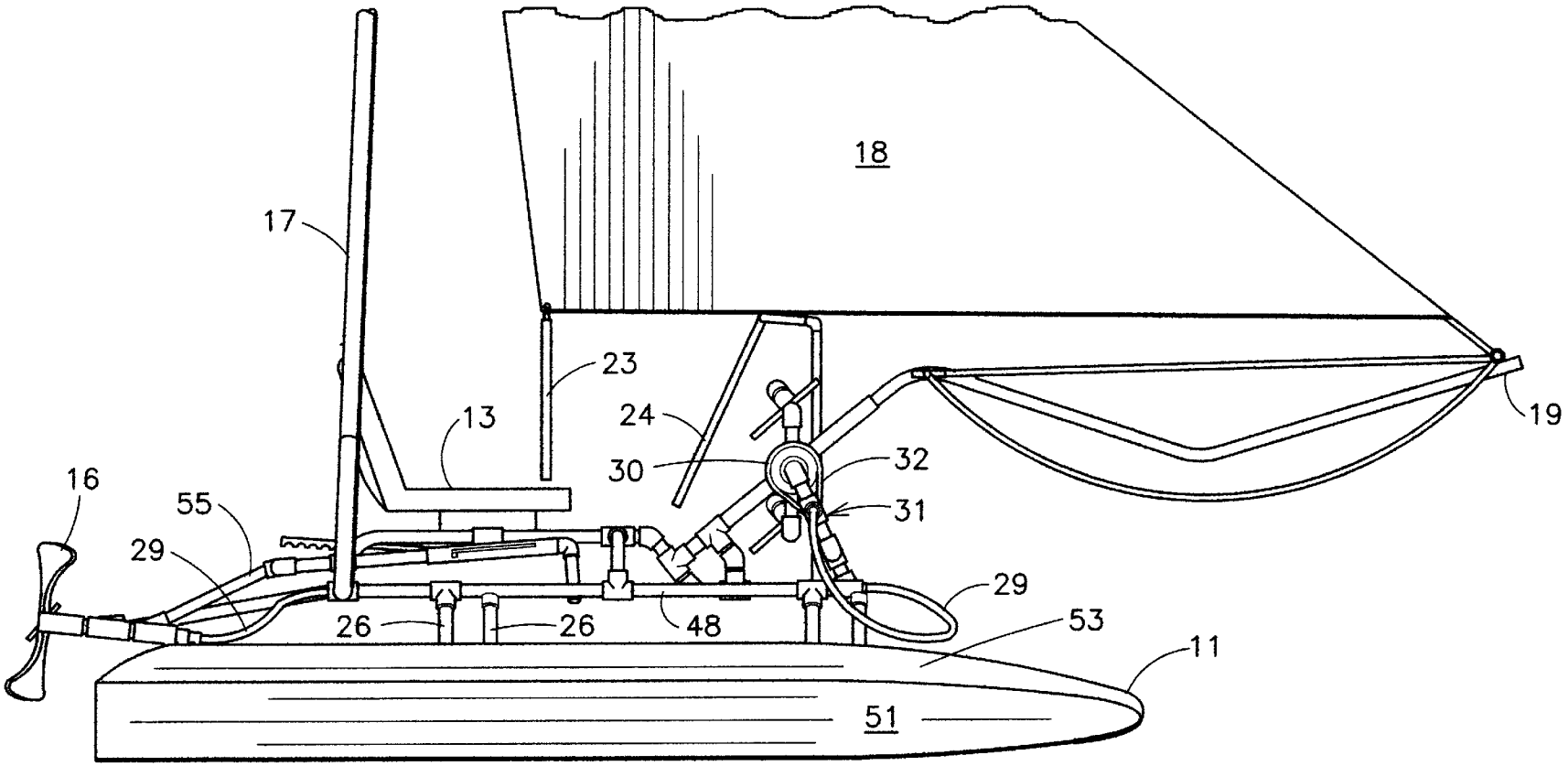
FIG. 3 is a side elevational view of the invention with the propeller in a retracted position.
Figure 4:
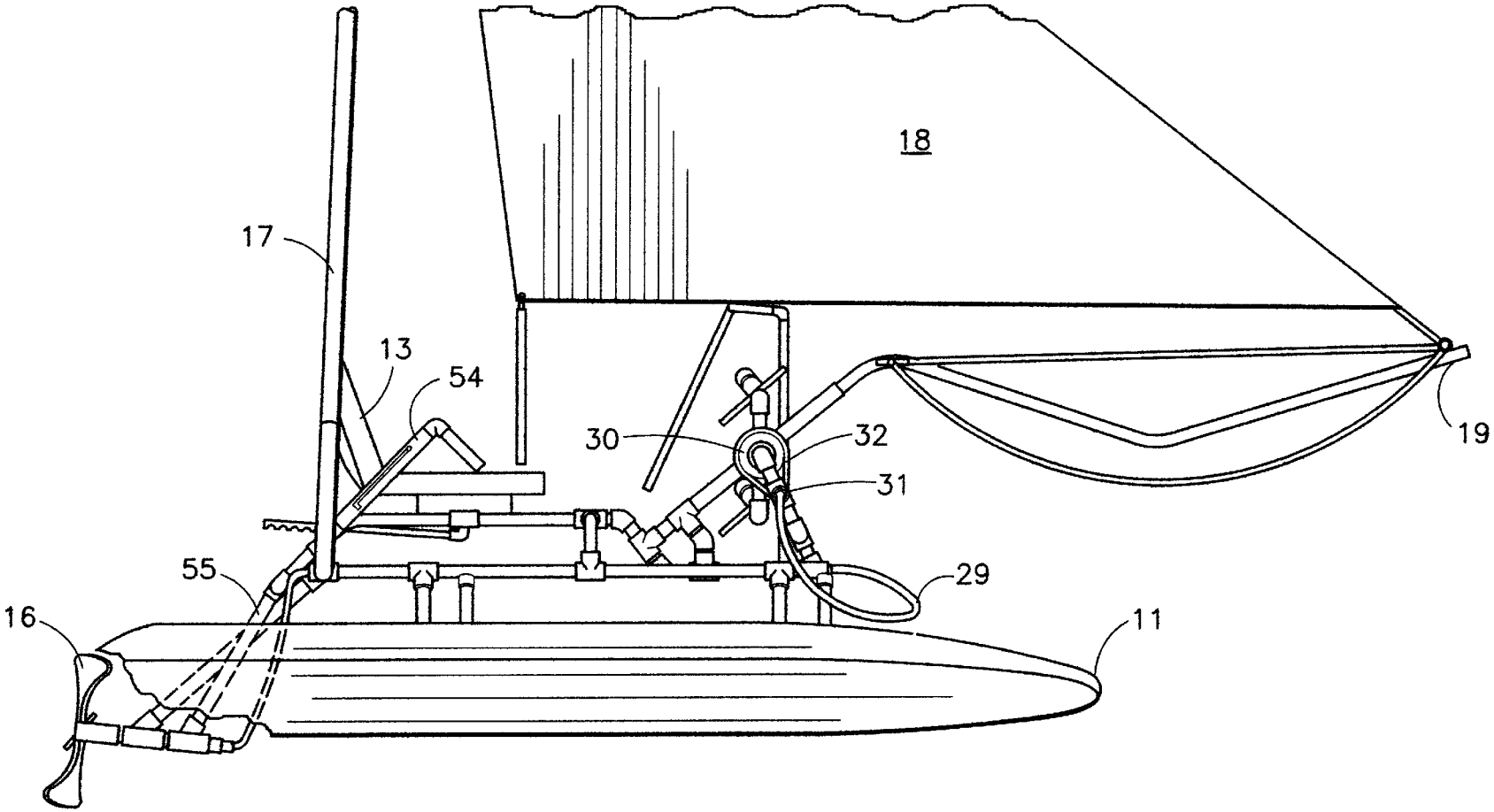
FIG. 4 is a side elevational view of the invention with the propeller in an operational position.

As show in FIGS. 3 and 4, the propeller frame 15 and propellers 16 are adjustable between a transport, or sailing, position shown in FIG. 3 and an operational position in FIG. 4. The propeller frame 15 is adjustable on the rear cross member 34, and is raised and lowered by the lever 54. The propeller frame 15 includes the propellers 16 connected to two extension members 55 which are pivotally attached to the main frame 12. The extension members 55 extend rearward from the stern of the vessel 10. The extension members 55 are attached to a first transverse member 56, adjacent the propellers 16, and which holds the extension members 55 in fixed space relationship to one another. The extension members 55 are also attached to a second transverse member 57 which is pivotally attached to the rear cross member 34 on the main frame 12.

A lever 54 is operably connected to the extension member by a second transverse member 57. As shown in FIG. 3, when the lever 54 is placed in a down position, the propeller frame 15, including the propellers 16, are pivoted to a retracted position. In this position, the water vessel 10 may be placed atop a trailer or the like for transportation. This position also enables a user to propel the vessel 10 by sail 18. As shown in FIG. 4, the lever 54 is released to place the propeller frame 15, including the propellers 16, in an operating position.

As previously mentioned above, the drive system includes means for independently operating respective pedals 14 so the propellers 16 are independently driven with respect to one another. This means for independent operation, of the pedals 14 and propellers, include a turnkey mechanism which is illustrated in more detail in FIGS. 14 through 16. This drive system includes a first connector 58 and a second connector 60 which are respectively attached to pedals 16. The first connector 58 has a horizontally disposed sleeve 59 and the second connector 60 has a horizontally disposed sleeve 61. The sleeves 59 and 61 abut one another and are maintained in alignment within casing 67.

Figure 17:
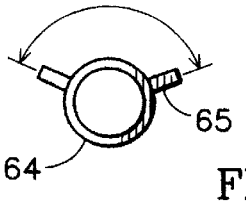
FIG. 17 is an end view of the key mechanism.

The sleeve 59 includes two first slots 62, and the sleeve 61 includes two second slots 63. A key cylinder 64 fits within the sleeves 59 and 61. The key cylinder 64 has two tabs 65 protruding upward therefrom for engagement of the sleeves 59 and 60 through respective slots 62 and 63. The tabs 65 are annularly spaced on the key cylinder the same distance or angle as the slots 62 and 63 to the tabs 65 may mate with the slots to operate the pedals. As shown in FIG. 17, the tabs 64 and 65 are preferably spaced apart about 135°. The tabs 65 may not be spaced 180° apart on the key cylinder.

As noted above, the key cylinder 64 has an outside diameter that is less than the inside diameter of the sleeves 59 and 61, so the key cylinder 64 is slidable and rotatable within the sleeves 59 and 61 and the casing 67.

Figure 15:
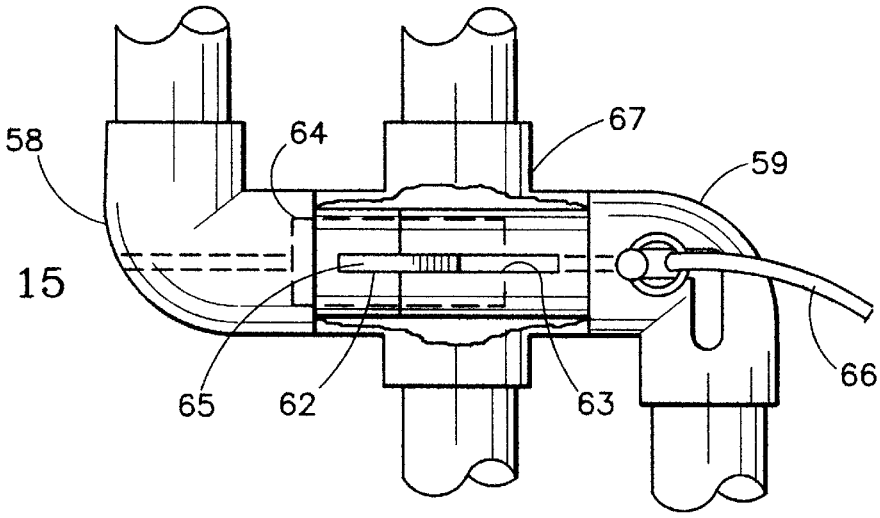
FIG. 15 is an expanded view of the key mechanism in an operational position.
Figure 16:
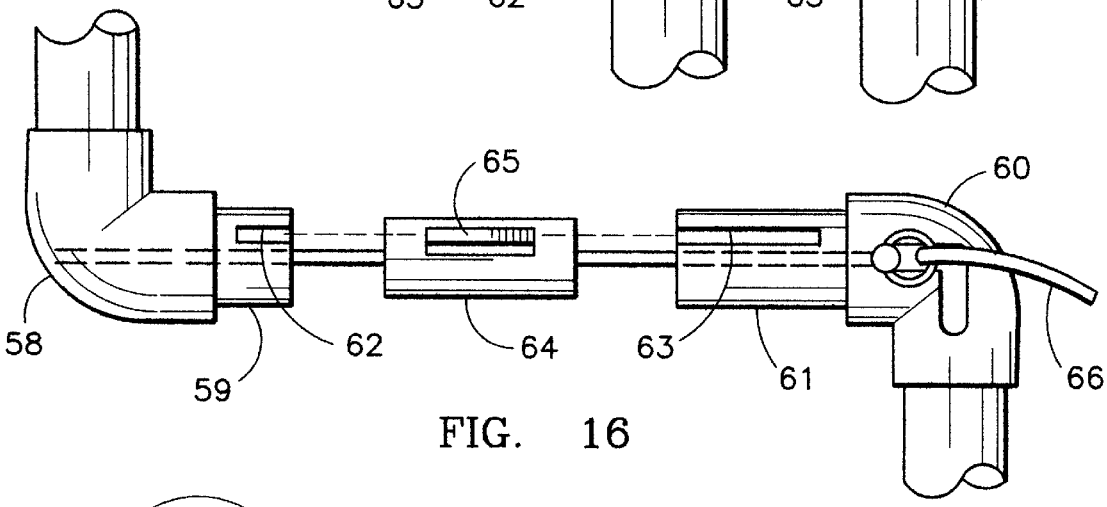
FIG. 16 is an expanded view of the key mechanism.

With respect to FIG. 15, the turnkey mechanism is in a position whereby the operation of one pedal 14 will drive the other pedal 14 and propeller 16. The first slots 62 and the second slots 63 are aligned. A resilient line 66 is secured to the first connector 58 and biases the key cylinder 64 toward the first connector 58. The first slots 62 on sleeve 59 are about half the length of the tabs 65, so the tabs 65 extend from the first slots 62 into the second slots 63 on the sleeve 61 of the second connector 60. As the tabs 65 mate, with both the first slots 62 and the second slots 63, the operation of one pedal 14 drives both pedals. This allows for the synchronized operation of the dual propellers 16 to drive the vessel 10 in a substantially straight direction. A rudder 25 operated by a tiller 24 facilitates the steering of vessel 10.

The cylinder key 64 may be disengaged so the pedals 14 may be operated independently. The line 66 is pulled toward the second connecter 60 so the tabs 65 are removed from the first slots 62 and mate entirely with second slots 63. The second slots 63 have a length that is greater than the length of the tabs 65 so the tabs 65 fit within the second slots 63 without engaging the first slots 62. As the tabs do not engage the first slots 62, and engage only the second slots 63, the pedals 14 are independently operable. When the pedals 14, and consequently the propellers 16, independently operable, the vessel 10 may be turned in either a forward or reverse direction along a much shorter turning radius as the propellers 16 are rotated in opposite directions.

Figure 14:
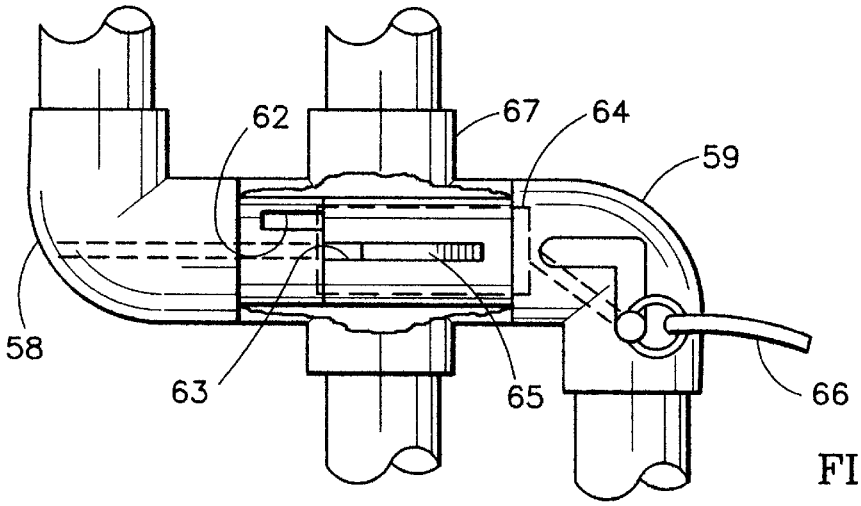
FIG. 14 is an elevational view of the key mechanism disengaged for independent operation of the pedals and propellers.

The key mechanism may be designed so that it provides for a temporary disengagement of the tabs 65. As shown in FIG. 14, the resilient line 66 is pulled to disengage the tabs 65. The user may turn the vessel 10 in a desired direction. When necessary to engage the tabs 65 with the first slots 62, the line 66 is released and the line 66 pulls the key cylinder 64 with tabs 65 toward the first slots 62. If the slots 62 and second slots are not aligned, the tabs 65 will engage the sleeve 59, and the pedals 14 are rotated until the first slots 62 and the second slots 63 are aligned. When the slots 62 and 63 are aligned the tension of the line 66 will pull the key cylinder 64 and the tabs 65 into engagement with the first slots 62 as shown in FIG. 15. Now both pedals 14 and propellers 16 will operate simultaneously.

While I have disclosed the preferred embodiment of my invention, it is not intended that this description in any way limits the invention, but rather this invention should be limited only by a reasonable interpretation of the now recited claims.

Having thus described my invention, what I claim as new and desire to secure by letters patent is:

1. A recreational water vessel, comprising:

(a) two water buoyant boards spaced apart, and each board having a respective bottom surface and a top surface;

(b) a main frame attached to the boards whereby said frame has a front facing a bow of the boards and a rear facing a stern of the boards, and said frame further has a passenger area;

(c) two propellers attached to the rear of the frame;

(d) a manually operated drive system mounted to the frame and connected to the propeller for the actuation of the propellers, whereby said drive system operates to simultaneously actuate the propellers;

(e) means, attached to the drive system, for the disengagement of the drive system for the independent actuation of the propellers with respect to one another; and, (f) sail means mounted to the frame to propel the boat under power of wind.

2. A recreational water vessel, as defined in claim 1, wherein each said board has an inner side surface and an outer side surface with respect to the frame, and the bottom surface of each board has a concave configuration, and each board is mounted to the frame whereby said inner side surface on each respective board is substantially vertically disposed.

3. A recreational water vessel, as defined in claim 1, further including means mounted to the frame and propellers for the selective adjustment of the propellers between an operational position and a storage or sailing position.

4. A recreational water vessel, as defined in claim 3, wherein each said board has an inner side surface and an outer side surface with respect to frame, and the bottom surface of each board is a concave configuration, and each board is mounted to the frame whereby said inner side surface on each respective board is substantially vertically disposed.

5. A recreational water vessel, as defined in claim 1, wherein said drive system includes two pedals and each pedal is drivably connected to a gear system which is drivably connected to a flexible axle, and each flexible axle is connected to a propeller.

6. A recreational water vessel, in claim 5, wherein said drive system disengagement means includes a key device mating with each of the pedals, and means for removing said key device from engagement with one of said pedals.

7. A recreational water vessel, as defined in claim 6, wherein a first pedal has two first slots annularly spaced apart on a sleeve attached to the first pedal, a second pedal has two second slots annularly spaced on a sleeve attached to the second pedal and said sleeves abut one another, and a said key device is a cylindrical key slidably mounted within the sleeves connected to the first and second pedal and said key having two tabs annularly spaced apart on the cylindrical key and in mating relationship with each of the slots when the slots on each of the sleeves are aligned, and means attached to the key for biasing said key toward the first pedal, and means for pulling the key toward the second pedal to remove the tabs from mating relationship from the first slots so said pedals and propellers are independently actuated with respect to one another.

8. A recreational water vessel, as defined in claim 7, wherein each said board has an inner side surface and an outer side surface with respect to frame, and the bottom surface of each board is a concave configuration, and each board is mounted to the frame whereby said inner side surface on each respective board is substantially vertically disposed.

9. A recreational water vessel, as defined in claim 8, further including means mounted to the frame and propellers for the selective adjustment of the propellers between an operational position and a storage or sailing position.

10. A recreational water vessel, as defined in claim 9, wherein said sail means includes a mast mounted to the rear of the frame and extending upward therefrom and a boom attached to the frame forward the mast, said boom pivotal toward a starboard and port side of the vessel, and a sail attached to the mast and boom.

11. A recreational water vessel, as defined claim 10, wherein said sail is a triangular sail folded in two halves and having a top attached to the mast, and a clew attached to the boom, and said sail has a fold extending from the boom to the mast forming two feet of the sail, and said water vessel having to sail handles attached to each foot of the sail.

12. A recreational water vessel, comprising:

(a) two water buoyant boards spaced apart, and each board having a respective bottom surface and a top surface;

(b) a main frame attached to the boards whereby said frame has a front facing a bow of the boards and a rear facing a stern of the boards, and said frame further has a seat, said main frame having a plurality of horizontally disposed support members;

(c) each said board has an inner side surface and an outer side surface with respect to the frame, and the bottom surface of each board has a concave configuration, and each board is mounted to the frame whereby said inner side surface on each respective board is substantially vertically disposed, with said inner side surfaces facing one another, and said top surface on each said respective board being disposed at an acute angle with respect to said horizontally disposed support members on the main frame; and, (d) manually operated means, mounted to the frame, for propelling the water vessel.

13. A water recreational vessel, as defined in claim 12, wherein said manually operated means for propelling the water vessel includes two propellers attached to the rear of the frame, a manually operated drive system mounted to the frame and connected to the propeller for the actuation of the propellers, whereby said drive system operates to simultaneously actuate the propellers, and means, attached to the drive system, for the disengagement of the drive system for the independent actuation of the propellers with respect to one another.

14. A recreational water vessel, as defined in claim 13, wherein said drive system includes two pedals and each pedal is drivably connected to a gear system which is drivably connected to a flexible axle, and each flexible axle extends to, and is connected to, a propeller.

15. A recreational water vessel, as defined in claim 14, wherein a first pedal has two first slots annularly spaced apart on a sleeve attached to the first pedal, a second pedal has two second slots annularly spaced on a sleeve attached to the second pedal and said sleeves abut one another, and a said key device is a cylindrical key slidably mounted within the sleeves connected to the first and second pedal and said key having two tabs annularly spaced apart on the cylindrical key and in mating relationship with each of the slots when the slots on each of the sleeves are aligned, and means attached to the key for biasing said key toward the first pedal, and means for pulling the key toward the second pedal to remove the tabs from mating relationship from the first slots so said pedals and propellers are independently actuated with respect to one another.

16. A recreational water vessel, as defined in claim 12, wherein said manually operated means for propelling the vessel includes a sail means having a mast mounted to the rear of the frame behind the seat and extending upward therefrom and a boom attached to the frame forward the seat, said boom pivotal toward a starboard and port side of the vessel, and a sail attached to the mast and boom.

17. A recreational water vessel, as defined claim 16, wherein said sail is a triangular sail folded in two halves and having a top attached to the mast, and a clew attached to the boom, and said sail has a fold extending from the boom to the mast forming two feet of the sail, and said water vessel having to sail handles attached to each foot of the sail.

18. A recreational water vessel, comprising:

(a) two water buoyant boards spaced apart, and each board having a respective bottom surface and a top surface;

(b) a main frame attached to the boards whereby said frame has a front facing a bow of the boards and a rear facing a stern of the boards, and said frame further has a seat; and, (c) a sail means having a mast mounted to the rear of the frame behind the seat and extending upward therefrom and a boom attached to the frame forward the seat, said boom pivotal toward a starboard and port side of the vessel, and a sail attached to the mast and boom, wherein said sail means includes a sail that is a triangular sail having a top attached to the mast, and a clew attached to the boom, and said sail has a fold extending from the boom to the mast forming two feet of the sail, and said water vessel having to sail handles attached to each foot of the sail.

19. A recreational water vessel, as defined in claim 18, wherein each said board has an inner side surface and an outer side surface with respect to frame, and the bottom surface of each board is a concave configuration, and each board is mounted to the frame whereby said inner side surface on each respective board is substantially vertically disposed.

20. A water recreational vessel, as defined in claim 18, wherein said water vessel further includes two propellers attached to the rear of the frame, a manually operated drive system mounted to the frame and connected to the propellers for the actuation of the propellers, whereby said drive system operates to simultaneously actuate the propellers, and means, attached to the drive system, for the disengagement of the drive system for the independent actuation of the propellers with respect to one another.

21. A recreational water vessel, comprising:

(a) two water buoyant boards spaced apart, and each board having a respective bottom surface and a top surface;

(b) a main frame attached to the boards whereby said frame has a front facing a bow of the boards and a rear facing a stern of the boards, and said frame further has a seat mounted thereon facing the front of the frame;

(c) two propellers attached to the rear of the frame;

(d) a manually operated drive system mounted to the frame and connected to the propeller for the actuation of the propellers, whereby said drive system operates to simultaneously actuate the propellers; and, (e) means, attached to the drive system, for the disengagement of the drive system for the independent actuation of the propellers with respect to one another.

22. A recreational water vessel, as defined in claim 21, wherein said drive system includes two pedals and each pedal is drivably connected to a gear system which is drivably connected to a flexible axle, and each flexible axle is connected to a propeller.

23. A recreational water vessel, as defined in claim 22, wherein said drive system disengagement means includes a key device mating with each of the pedals, and means for removing said key device from engagement with one of said pedals.

24. A recreational water vessel, as defined in claim 23, wherein a first pedal has two first slots annularly spaced apart on a sleeve attached to the first pedal, a second pedal has two second slots annularly spaced on a sleeve attached to the second pedal and said sleeves abut one another, and a said key device is a cylindrical key slidably mounted within the sleeves connected to the first and second pedal and said key having two tabs annularly spaced apart on the cylindrical key and in mating relationship with each of the slots when the slots on each of the sleeves are aligned, and means attached to the key for biasing said key toward the first pedal, and means for pulling the key toward the second pedal to remove the tabs from mating relationship from the first slots so said pedals and propellers are independently actuated with respect to one another.

25. A recreational water vessel, as defined in claim 21, wherein each said board has an inner side surface and an outer side surface with respect to the frame, and the bottom surface of each board has a concave configuration, and each board is mounted to the frame whereby said inner side surface on each respective board is substantially vertically disposed, and said inner side surfaces facing one another.

26. A recreational water vessel, as defined in claim 21, wherein said water vessel further includes sail means having a mast mounted to the rear of the frame behind the seat and extending upward therefrom and a boom attached to the frame forward the mast and the seat, said boom pivotal toward a starboard and port side of the vessel, and a sail attached to the mast and boom.

27. A recreational water vessel, as defined claim 26, wherein said sail is a triangular sail folded in two halves and having a top attached to the mast, and a clew attached to the boom, and said sail has a fold extending from the boom to the mast forming two feet of the sail, and said water vessel having to sail handles attached to each foot of the sail.

28. A recreational water vessel, comprising:

(a) two water buoyant boards spaced apart, and each board having a respective bottom surface and a top surface;

(b) a main frame attached to the boards whereby said frame has a front facing a bow of the boards and a rear facing a stern of the boards, and said frame further has a passenger area;

(c) a propeller attached to the rear of the frame;

(d) a manually operated drive system mounted to the frame and connected to the propeller for the actuation of the propeller; and, (f) sail means mounted to the frame to propel the boat under power of wind.

29. A recreational water vessel, as defined in claim 28, wherein each said board has an inner side surface and an outer side surface with respect to the frame, and the bottom surface of each board has a concave configuration, and each board is mounted to the frame whereby said inner side surface on each respective board is substantially vertically disposed.

30. A recreational water vessel, as defined in claim 28, further including means mounted to the frame and the propeller for the selective adjustment of the propeller between an operational position and a storage or sailing position.

31. A recreational water vessel, as defined in claim 30, wherein each said board has an inner side surface and an outer side surface with respect to the frame, and the bottom surface of each board is a concave configuration, and each board is mounted to the frame whereby said inner side surface on each respective board is substantially vertically disposed.

32. A recreational water vessel, as defined in claim 28, wherein said propeller is a first propeller and said water vessel further includes a second propeller, said drive system operates to simultaneously actuate the first and second propellers, and said water vessel further including means, attached to the drive system, for the disengagement of the drive system for the independent actuation of the first and second propellers with respect to one another.

33. A recreational water vessel, as defined in claim 32, wherein said drive system includes two pedals and each pedal is drivably connected to a gear system which is drivably connected to a flexible axle, and each flexible axle is connected to the first and second propellers.

34. A recreational water vessel, in claim 33, wherein said drive system disengagement means includes a key device mating with each of the pedals, and means for removing said key device from engagement with one of said pedals.

35. A recreational water vessel, as defined in claim 34, wherein a first pedal has two first slots annularly spaced apart on a sleeve attached to the first pedal, a second pedal has two second slots annularly spaced on a sleeve attached to the second pedal and said sleeves abut one another, and a said key device is a cylindrical key slidably mounted within the sleeves connected to the first and second pedal and said key having two tabs annularly spaced apart on the cylindrical key and in mating relationship with each of the slots when the slots on each of the sleeves are aligned, and means attached to the key for biasing said key toward the first pedal, and means for pulling the key toward the second pedal to remove the tabs from mating relationship from the first slots so said pedals and propellers are independently actuated with respect to one another.

36. A recreational water vessel, as defined in claim 32, wherein each said board has an inner side surface and an outer side surface with respect to frame, and the bottom surface of each board is a concave configuration, and each board is mounted to the frame whereby said inner side surface on each respective board is substantially vertically disposed.

37. A recreational water vessel, as defined in claim 36, further including means mounted to the frame and propellers for the selective adjustment of the propellers between an operational position and a storage or sailing position.

38. A recreational water vessel, as defined in claim 37, wherein said sail means includes a mast mounted to the rear of the frame and extending upward therefrom and a boom attached to the frame forward the mast, said boom pivotal toward a starboard and port side of the vessel, and a sail attached to the mast and boom.

39. A recreational water vessel, as defined claim 38, wherein said sail is a triangular sail folded in two halves and having a top attached to the mast, and a clew attached to the boom, and said sail has a fold extending from the boom to the mast forming two feet of the sail, and said water vessel having to sail handles attached to each foot of the sail.

* * * * *